United States Patent [19]

Jursich et al.

[11] Patent Number: 5,058,271

[45] Date of Patent: Oct. 22, 1991

[54] SHOWER SHAVER WITH STEAM FREE MIRROR

[75] Inventors: Donald N. Jursich, Chicago; Jefferson L. Gentry, Deerfield, both of Ill.

[73] Assignee: Associated Mills Inc., Chicago, Ill.

[21] Appl. No.: 599,629

[22] Filed: Oct. 18, 1990

Related U.S. Application Data

[63] Continuation-in-part of Ser. No. 501,029, Mar. 29, 1990, Pat. No. 4,995,155.

[51] Int. Cl.[5] ..... B25F 3/00; B26B 19/06; B26B 19/44

[52] U.S. Cl. ..... 30/123; 30/34.1; 30/41.5

[58] Field of Search ..... 30/34.1, 41.5, 123, 30/90; 132/304, 316

[56] References Cited

U.S. PATENT DOCUMENTS 4,733,468 3/1988 Zadro ..... 30/41.5

*Primary Examiner*—Douglas D. Watts
*Assistant Examiner*—Paul M. Heyrana, Sr.
*Attorney, Agent, or Firm*—Laff, Whitesel, Conte & Saret

[57] ABSTRACT

The invention provides a combination of a shower shaver and a steam free mirror. A nipple fits between a plumbing pipe and a shower head. A T-shaped fitting is coupled to the nipple to receive a certain amount of shower water which is bled off during a shower. The other ends of the T-shaped fitting are coupled to said shower shaver and to a steam free mirror, respectively, whereby water from the shower is used both to lubricate and rinse said shaver and to control the temperature of said mirror.

17 Claims, 1 Drawing Sheet

SHOWER SHAVER WITH STEAM FREE MIRROR

This is a continuation-in-part application of U.S. Ser. No. 07/501,029 filed Mar. 29, 1990. Now U.S. Pat. No. 4,995,155.

This invention relates to shower having equipment and, more particularly, to a combination of a shaver and a steam free mirror for use therewith.

Water provides one of the best lubricants for a blade shave while various soaps, lathers, creams and the like, which are used prior to and during shaving, are generally used merely to enable the water to better wet the skin. Therefore, any advance which enables the water to get closer to the actual surface of the skin usually represents an improvement in a use of a blade razor.

For these and other reasons, it has become popular to shave while one is showering. In general, the presence of the water, high humidity steam, and the like, all contribute to a better wetting of the skin. This is especially true with women who may wish to shave their arms, legs, etc., since it is rather awkward to attempt to wet the skin at the extremity of a leg, for example, in anything other than a shower.

On the other hand, people also like to look into a mirror while they are shaving themselves. However, in the hot steamy atmosphere of a shower, the mirror is very likely to fog or steam over and, thus, defeat the convenience of the shower shave. There are mirrors which are designed for use in a hot and humid environment of a shower. However, they require plumbing connections, as does a shower shaver. Thus, the shower stall soon becomes a jungle of accessory equipment, which could raise safety considerations.

Another consideration is that, to use this type of equipment, it is necessary to make connections with plumbing which has been previously installed in a shower stall. It is not convenient for the user to disassemble the plumbing in his house merely to install this type of shaving equipment. Therefore, an adapter may be provided to make a connection to the plumbing, but when there is both a mirror and a shaver, there would be a conflict between the adapters for the two devices. Accordingly, there is a need for adding this type of equipment to existing plumbing without the area becoming so cluttered that it is not convenient to use anything.

Accordingly, an object of the invention is to mount the necessary equipment at a minimum cost without unduly cluttering the shower stall area.

Another object of the invention is to provide a mirror which does not become steamy in the environment of a hot shower.

Another object of the invention is to provide a razor at the end of a relatively long tube so that the razor may be used at virtually any position on the body while a person is at virtually any location inside a shower stall, all without creating such a tube which is so long that the shower shaver becomes a hazard to the user.

Still another object of the invention is to accomplish the above stated objects without causing an unsafe clutter within a shower stall.

In keeping with an aspect of this invention, these and other objects are accomplished by a mirror which clamps around the existing plumbing pipe leading to a shower head. A nipple is inserted between the plumbing pipe and the shower head in order to provide a diverter for bleeding off a little of the shower water. A valve on the nipple selects between bleeding off a little or transmitting of all water to the shower head itself. Coupled to the valve is a T-shaped fitting which extends the bled off water to both a mirror and to a shower shaver. The water which is extended through the fitting to the mirror runs through a cavity within the mirror in order to warm it and prevent it from attracting a condensation, thus keeping the surface of the mirror free of steam. The other side of the T-fitting extends through a tubing to the shower shaver where water is delivered to the cutting edge of the blade.

A preferred embodiment of the invention is shown in the attached drawings wherein.

Figure 1:
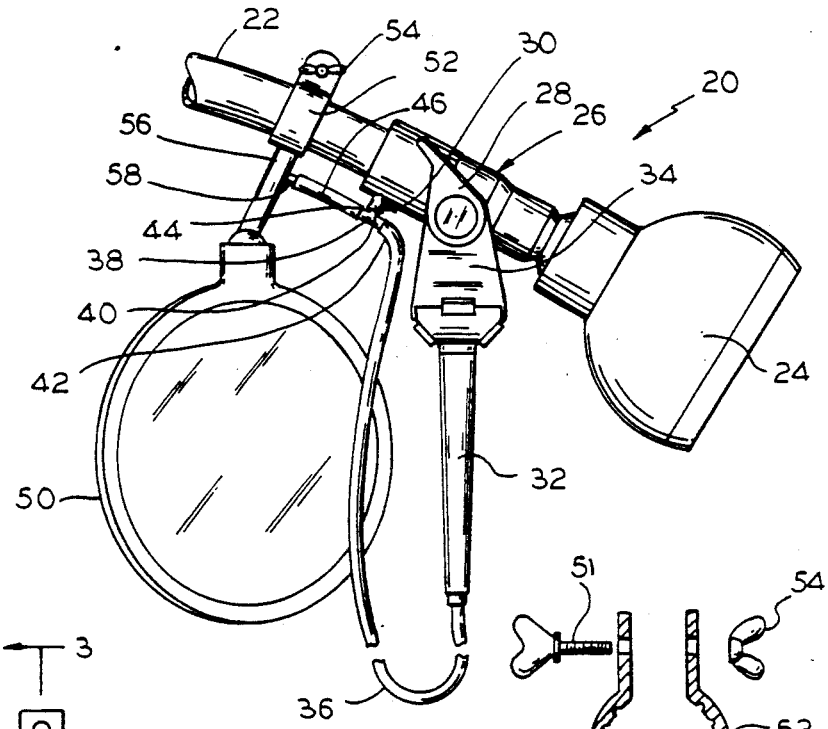
FIG. 1 is a side elevation of a shower head, shower shaver, and steam free mirror incorporating the invention.

FIG. 1 shows the entire shower shaver assembly 20. A plumbing pipe 22 extends from any suitable in-house plumbing through the wall of a shower stall and onto a shower head. Usually, the shower head 24 may be removed from the plumbing pipe 22 simply by unscrewing it. A nipple 26 may be placed on the end of the plumbing pipe 22 and then the shower head 24 may be placed on the nipple 26. A diverter valve 28 may be rotated in one direction to bleed a little of the shower water into a diverter 30. If the valve 28 is rotated in another direction, no water is bled off and all the water passing through the plumbing pipe 22 emerges from the shower head 24.

Freely rotatable upon and hanging from the valve 28, a hanger 34 may receive a shower shaver 32. When the shower shaver 32 is hung upon the hanger 34, gravity causes it to hang down in a rest position. A suitable tube 36 couples the shower shaver 32 to the diverter 30. Since the shower shaver 32 is hanging at the height of the shower head 24, the tube 36 may form a long loop which hangs down almost to the floor thus providing an extremely long tube which enables shower shaver 32 to be used in almost any position on a human body although the person using it may be standing or sitting almost any place in the shower stall. The tube wall is very thin so that there is great flexibility to enable the person to manipulate the shaver, almost unimpededly.

The shower shaver and associated equipment described thus far are described in much greater detail in a co-pending U.S. patent application Ser. No. 07/501,029, filed Mar. 29, 1990, and assigned to the assignee of this invention. Reference may be made to that co-pending application for greater detail.

Figure 4:
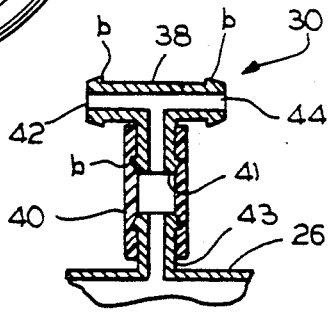
FIG. 4 is a cross section of a T-shaped fitting for use with the invention in order to divert bled off shower water to both the mirror and shower shaver.

The diverter 30 comprises a T-fitting 38 (FIG. 4) coupled to nipple 26 via a suitable tube 40. The T-fitting has three branches 41, 42, 44, each surrounded by a barb (as at "b") which helps capture a flexible tube slipped over the branch. Preferably, the tube 40 is sufficiently elastic to the extent that it slips over the stem 41 of "T" 38 and forms a seal merely by stretching over the confronting port pipes 41, 43 on the "T" and nipple 26. However, the tubing 40 should not be so flexible that it may be dislodged simply by normal use during the normal lifetime of the appliance. The tubing 36 (FIG. 1)

leading to the shower shaver 32 is coupled with one port pipes 42 (FIG. 4) at one of the ends of the cross-member of the T-fitting 38. The other end 44 of the cross-member of the T-fitting is coupled via a short tube 46 (FIG. 1) to a steam free mirror 50. Thus, when the valve 28 is rotated in a proper direction, a portion of the shower water is bled off and fed to both the shower shaver 32 and the steam free mirror 50.

The steam free mirror 50 is attached to the plumbing pipe 22 by means of a suitable clamp 52 which is held in place over the plumbing pipe 22 by means of a bolt 51 (FIG. 3) and wing nut 54.

Figure 2:
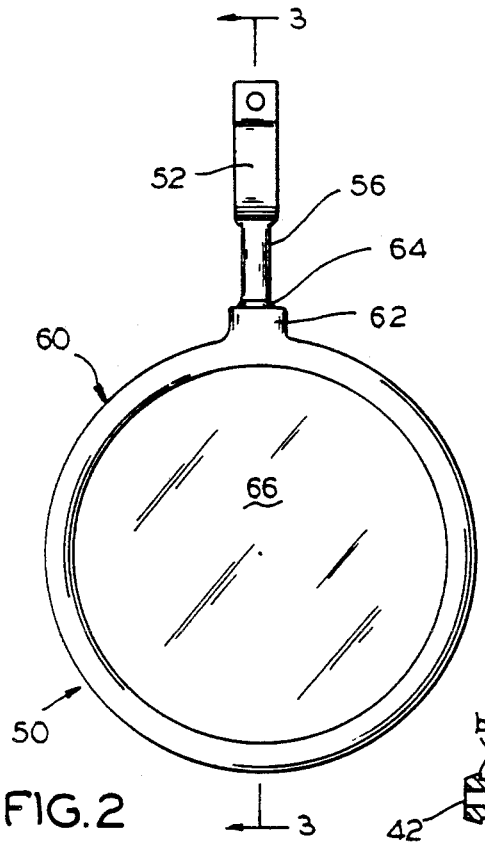
FIG. 2 is a front plan view of the steam free mirror.
Figure 3:
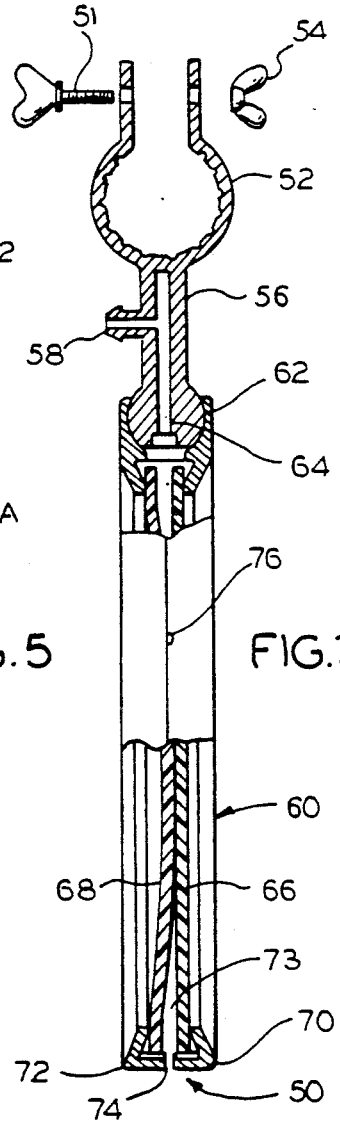
FIG. 3 is a cross section taken along lines 3—3 of FIG. 2.

The details of the steam free mirror 50 are shown in FIGS. 2 and 3. The mirror 50 comprises a frame 60 having a socket 62 which receives a ball 64 that is intregrally molded with the tube 56. The tube 56 includes a port pipe 58 that makes connection with the short tubing 46 which leads to the T-fitting 38. Therefore, when water is bled off the shower, part of it flows through port 58 and tube 56 to an interior of the mirror as best seen in FIG. 3.

The mirror frame 60 is comprised of two separate frame halves 70, 72. These two frame halves fit together and are joined in a face-to-face confrontation which enables the socket 62 to capture the ball 64 when the two frame halves are suitably joined together. Mirror 66 has a plane surface and is suitably attached and peripherally sealed to one of the frame halves 70. A second mirror 68 is suitably attached and sealed to the other of the mirror frame halves 72. The method of attaching the frame halves to each other is irrelevant to the invention. It is thought that cement, heat staking, or welding is the preferred method of attachment. Regardless of the method used, there should be a water tight seal at the peripheries of the mirrors so that water does not emerge from the interior of the frame 60 to run over the surface of the mirrors 66 or 68.

One of the mirrors, 66, is flat and planar to give a normal and unmagnified image of the viewer. The other mirror, 68, is concave to provide suitable magnification. Each of the mirrors is pre-formed and pre-surfaced in any suitable manner in order to provide a mirror. It is presently thought that one of the well known acrylic materials is a preferred material for the mirrors.

Once the mirrors have securely fastened to their respective frames 70, 72 the two frames are joined together in any suitable manner. Thus, a cavity 73 is formed between the two mirrors to receive the diverted shower water. Since the water heats the backs of the mirrors to the ambient shower stall temperature, no condensation forms on the mirror surface.

A number of openings are provided around substantially the entire perimeter of the frame 60. Two of those openings are seen at 74 and 76. Each opening may be made simply by leaving a suitable notch in one or both of the frames 70–72. The principal is that the holes will be small enough to enable water to accumulate inside the cavity between mirrors 66 and 68; however, the holes will also be large enough so that there will be a continuous flow of the hot shower water through the cavity 73 within the mirror. Thus, the backs of the mirrors 66, 68 are heated to a temperature which makes them the same as the ambient temperature within the shower stall. Therefore, no condensation will be accumulated on the surfaces of the mirrors.

The fit between ball 62 and socket 64 is such that the mirror may be rotated freely to almost any convenient angle; however, once it is so rotated the friction of the socket alone will hold the mirror in its position.

Figure 5:
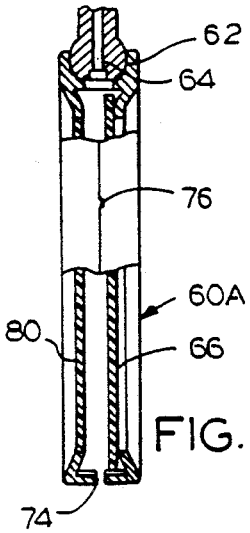
FIG. 5 is similar to FIG. 3 except that a blank panel is provided in place of the magnifying mirror.

In another embodiment (FIG. 5), the frame 74 may have integrally formed therewith a solid and uninterrupted back panel 80. The remainder of the parts of FIG. 5 are the same as the correspondingly numbered parts of FIG. 3. Therefore, a less expansive steam free mirror may be provided by eliminating the magnifying mirror 68.

Those who are skilled in the art will readily perceive how to modify the invention. Therefore, the appended claims are to be construed to cover all equivalent structures which fall within the true scope and spirit of the invention.

The claimed invention is:

1. Shower shaving equipment comprising:
a shower shaver,
a mirror having at least one mirror with a cavity behind it,
a nipple adapted to be fitted between a plumbing pipe and a shower head, said nipple having a freely rotatable hanger dependent therefrom,
a diverter port formed in said nipple for expelling a stream of water bled off of the connection between the plumbing pipe and the shower head,
a T-fitting attached to said diverter port,
means for coupling one side of said T-fitting to a shower shaver, and
means for coupling the other side of said T-fitting to said cavity behind said mirror for heating said mirror to ambient temperatures.

2. The equipment of claim 1 wherein said nipple comprises a valve for selectively bleeding off a stream of shower water to said diverter port or for conveying all water to said shower head.

3. The equipment of claim 2 and means coupled to said diverter for conveying water to said cavity behind said mirror and adjacent to the back of said mirror.

4. Shower shaving equipment including a steam free mirror for use in a shower, said mirror comprising:
clamp means for securely associating said mirror with a shower head,
a tube extending between said clamp means and said mirror via a ball and socket joint,
a mirror frame providing a cavity behind said mirror, at least one mirror sealed to and enclosed within said frame with said cavity in direct communication with a back surface of said mirror,
a passage way for water extending from a source of water for said shower head to said tube then through said ball and socket joint and into said cavity behind said mirror,
a plurality of drain holes formed in said frame for allowing water to escape from said frame.

5. The equipment of claim 4 and means interposed between said source of water and said shower head for bleeding off some water which is diverted to said passage way and onto said cavity.

6. The equipment of claim 5 wherein said mirror has a magnifying mirror surface.

7. The equipment of claim 5 wherein said drain holes are distributed around substantially the perimeter of said frame whereby water entrapped in said cavity within said frame is expelled in many directions, the expelling of said water drawing water substantially uniformly throughout said frame and across the rear surface of said mirror.

8. The equipment of claim 4 and a closed surface on said mirror frame for completing the cavity behind said cavity.

9. The equipment of claim 4 and a plane mirror on said mirror frame for completing the cavity behind said magnifying mirror.

10. The equipment of claim 4 wherein said clamp means is a bifurcated member having two sides which fit over a plumbing pipe and for supplying said shower head, and means for drawing said bifurcated members together to tightly embrace said plumbing pipe.

11. The equipment of claim 10 wherein said frame comprises two frame members each having a half of said socket formed therein for receiving said ball of said joint, said ball being associated with said bifurcated clamp, each of said two frame members receiving a mirror which is bonded thereto, and means for securing said two frame members in face-to-face contact with said ball capture in said socket formed between said mirror members.

12. The equipment of claim 4 and a T-fitting coupled between said plumbing pipe and said shower head, said T-fitting having a first branch coupled to receive shower water which is bled off from water passing through said plumbing pipe and out of said shower head, a second branch of said T-fitting being coupled to an input to said cavity and a third branch of said T-fitting being coupled to a shower shaver.

13. The equipment of claim 12 and a relatively long extremely thin walled plastic tube extending from said third branch of said T-shaped fitting to a razor blade in said shower shaver.

14. The equipment of claim 13 wherein at least one barb surrounds a port pipe forming each of said branches of said T-fitting, said barb capturing a flexible tube which may be slipped thereover.

15. A steam free mirror comprising a bifurcated clamp attached to a tube having an entrance port at one end thereof, the other end of said tube terminating in a ball with a passageway communicating with said tube, a frame formed of two parts having complementary socket halves formed therein to receive said ball when said frame parts are joined together in a face-to-face relationship, a mirror supported in one of said frame parts, means included in the other of said parts for completing a cavity behind said mirror, and means for emitting water from said cavity in a pattern which uniformly heats the back of said mirror.

16. The mirror of claim 15 wherein said means for completing said cavity is a second mirror, one of said mirrors being a plane mirror, the other of said mirrors being a magnifying mirror.

17. The mirror of claim 15 wherein said means for completing said cavity is a blank panel.

* * * * *